US006439759B1

(12) United States Patent
Ray et al.

(10) Patent No.: US 6,439,759 B1
(45) Date of Patent: Aug. 27, 2002

(54) DEVICES FOR BLENDING MATERIALS INCLUDING A PAIR OF KNEADING PADDLES CAUSING THE CONTENTS OF A CONTAINER TO CIRCULATE

(75) Inventors: Stuart John Ray, London; Kevin John Lanchester, Norwich, both of (GB)

(73) Assignee: Seward Limited, London (GB)

( * ) Notice: Subject to any disclaimer, the term of this patent is extended or adjusted under 35 U.S.C. 154(b) by 0 days.

(21) Appl. No.: 09/786,915

(22) PCT Filed: Aug. 31, 1999

(86) PCT No.: PCT/GB99/02855

§ 371 (c)(1),
(2), (4) Date: Mar. 9, 2001

(87) PCT Pub. No.: WO00/15328

PCT Pub. Date: Mar. 23, 2000

(30) Foreign Application Priority Data

Sep. 11, 1998 (GB) ..... 9819897

(51) Int. Cl.[7] ..... B01F 11/00
(52) U.S. Cl. ..... 366/197
(58) Field of Search ..... 366/108, 110, 366/111, 117, 197, 198, 200, 201, 202, 204, 212, 349, 332–335

(56) References Cited

U.S. PATENT DOCUMENTS 2,107,851 A * 2/1938 Boehm
2,235,942 A * 3/1941 Moore
2,336,438 A * 12/1943 Evans
2,406,535 A * 8/1946 Foote
2,419,330 A * 4/1947 Anderson
2,539,457 A * 1/1951 Metheny et al.
3,030,081 A * 4/1962 Wilson et al.
3,096,081 A * 7/1963 Helm et al.
3,132,848 A * 5/1964 Garlinghouse
3,503,592 A * 3/1970 Taylor, Sr. et al.
3,722,833 A * 3/1973 Inoue et al.
3,771,773 A * 11/1973 Schriever
3,819,158 A * 6/1974 Sharpe et al.
4,795,265 A * 1/1989 Dahlberg et al.
5,618,105 A * 4/1997 Baker
5,632,554 A * 5/1997 Wang et al. ..... 366/208
5,779,974 A * 7/1998 Kuzyk
5,913,603 A * 6/1999 Sperry et al. ..... 366/204
6,142,661 A * 11/2000 LaFond ..... 366/204
6,273,600 B1 * 8/2001 Sharpe

FOREIGN PATENT DOCUMENTS

DE 2243494 * 3/1973
DE 4426421 * 2/1996
WO 97/43039 * 11/1997
WO 00/53303 * 9/2000

OTHER PUBLICATIONS

Patent Abstracts of Japan, vol. 8, No. 102 (C–222), May 12, 1984 & JP 59–016532 A (Hitachi Koki KK), Jan. 27, 1984.*
Patent Abstracts of Japan, vol. 11, No. 262 (C–442), Aug. 25, 1987 & JP 62–065724 A (Chiyoda Tech & Ind Co Ltd), Mar. 25, 1987.*

* cited by examiner

*Primary Examiner*—Charles E. Cooley
(74) *Attorney, Agent, or Firm*—Jensen & Puntigam, P.S.

(57) ABSTRACT

A device for blending materials comprising a carrier support (1) arranged to support a closed bag (3) containing a material to be blended, a kneading mechanism in the form of paddles (5) which are arranged to apply a kneading action to the bag walls for homogenizing its contents, and a clamping device (4) for holding the bag closed and against the carrier support (1) during kneading. The kneading mechanism (5) is arranged to act in conjunction with the carrier support (1) and an island baffle (7) to cause the contents of the bag to circulate during kneading.

14 Claims, 2 Drawing Sheets

DEVICES FOR BLENDING MATERIALS INCLUDING A PAIR OF KNEADING PADDLES CAUSING THE CONTENTS OF A CONTAINER TO CIRCULATE

TECHNICAL FIELD

This invention relates to devices for blending materials eg mixing components of a mixture or homogenizing single components. The materials blended may be liquids or semi-liquid matter, and in some cases solids, powders or even gases. The invention is particularly concerned with the preparation of samples for bacteriological or chemical testing, but may also be used for the preparation of blended foods for example batters, pastries, sauces, baby foods and for the mixing of glues or paints or animal feeds additives.

BACKGROUND ART

A known blending device for preparation of bacteriological samples uses paddles and is described in GB 1 402 538. In use the specimen and diluent are contained in a sterile plastic bag and the paddles apply forces to the outside of the bag. This means that after processing the blender apparatus does not need to be cleaned and sterilized in preparation for further specimens, and so prevents cross contamination. This device includes two rectangular paddles of identical size and shape. The forces they impart to the sample are, for the most part, crushing. The reciprocating action of the paddles squeezes the specimen from side to side horizontally within the bag so mixing the resulting debris.

An examination of the fluid dynamics of this arrangement by the applicants has shown that the mixing action is most effective at the bottom of the bag and is reduced towards the top with an area between the tops of the paddles where the homogenization is minimal compared to the rest of the bag. Moreover we have appreciated that movement of liquid within the bag is important as it provides a form of washing action. The extraction of organisms requires the crushing or squeezing action and the washing action to not only release the organisms from the sample but also to drive them in to suspension. The resulting suspension must be as homogenous as possible and as representative as possible of the material under test.

DISCLOSURE OF THE INVENTION

It is an object of the present invention to provide an improved blender which alleviates the problems of the prior art.

According to the present invention there is provided a device for blending materials comprising a carrier support arranged to support a closed bag containing a material to be blended, a kneading means which is arranged to apply a kneading action to the bag walls for homogenising its contents, and holding means for holding the closed bag against the carrier support during kneading, the kneading means being arranged to act in conjunction with the carrier support to cause the contents of the bag to circulate during kneading.

Circulation of the contents is advantageous because it can provide more uniform or effective mixing and homogenization.

The holding means may comprise clamping means. When open ended sample bags are used the clamping means can be arranged to provide a temporary seal at the open end.

The kneading means may comprise at least one paddle arranged to act on the bag. Where a plurality of paddles are provided, the paddles can each be arranged to act on a different area of the bag, preferably while mutually out of phase.

Where the kneading means comprise at least one paddle said paddle can be shaped and dimensioned to cause and/or encourage circulation. Generally there should be a pair of paddles which are asymmetrically arranged with respect to each other in a manner which promotes circulation.

Each paddle may have a kneading surface which acts on the bag during kneading. The kneading surface can be shaped to cause and/or encourage circulation. In particular, the kneading surface may have a broad end and a narrow end. The displacement caused by the paddle at the broad end will then be greater than at the narrow end. This will tend to cause the contents of the bag to move in a direction from the broad end to the narrow end as the kneading surface acts on the bag.

Each paddle can be arranged so that some portions of the kneading surface contact the bag before other portions of the kneading surface during kneading. This may cause/encourage movement of the contents.

A pair of paddles can be provided in an opposed relation such that the broad end of each paddle is arranged to act on the bag at a region adjacent to a region at which the narrow end of the respective other paddle is arranged to act. Arranging such a pair of paddles to act on the bag in anti-phase is one way to produce a circulation of the contents of the bag.

The kneading surface may be generally triangular. Each side of the generally triangular shape may be curved.

An island baffle can be provided and arranged to cause, encourage or allow circulation around the baffle to occur. The island baffle can be maintained in a fixed relation to the bag. Where a pair of paddles are provided the island baffle can be located between the paddles. Facing surfaces of the island baffle and one or more associated paddle can be spaced from one another. The spacing at the broad end of the paddle can be less than at the narrow end. The facing surfaces of the baffle can be convex, the facing surface of the paddle can be concave.

Preferably the arrangement is such that extruding of the material occurs as it circulates.

Preferably one end of the island baffle is spaced from one internal boundary of the bag so that a first gap is defined between that end and the respective boundary, while the other end of the island baffle may be spaced from an opposing internal boundary of the bag so that a second gap is defined between said other end and said opposing boundary.

Preferably the apertures are arranged so that when material is circulating, during kneading, the material passes through one gap in a first direction and through the other gap in an opposing direction.

Preferably the material is extruded on passing through each gap.

A lower internal boundary such as a lower end seal of the bag in a plane of circulation may be arcuate, and preferably is semi-circular. This can encourage circulation. The curvature of the boundary may closely match a curvature of another facing surface or surfaces of one or more paddle. The boundary and said other facing surface(s) will usually be substantially parallel.

BEST MODE FOR CARRYING OUT THE INVENTION

Figure 1:
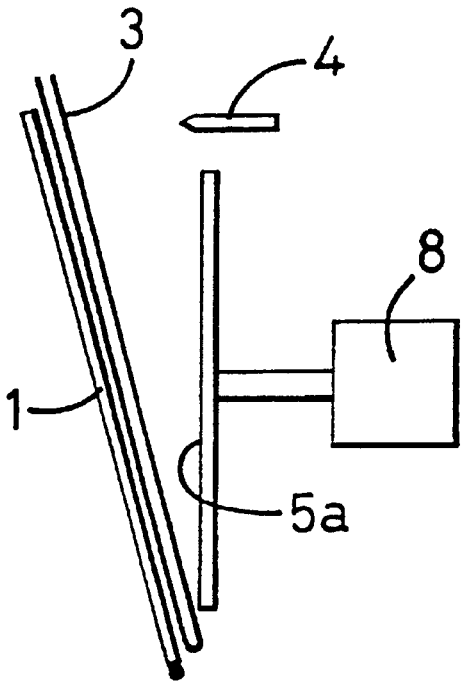
FIG. 1 is a side schematic view of a blending device prior to being loaded.
Figure 2:
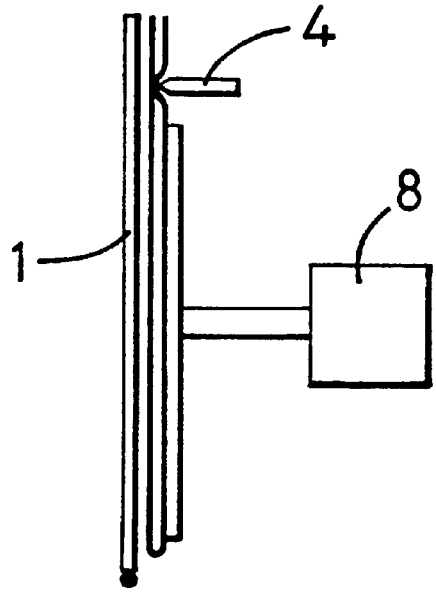
FIG. 2 is a side schematic view of the blending device when loaded.
Figure 4:
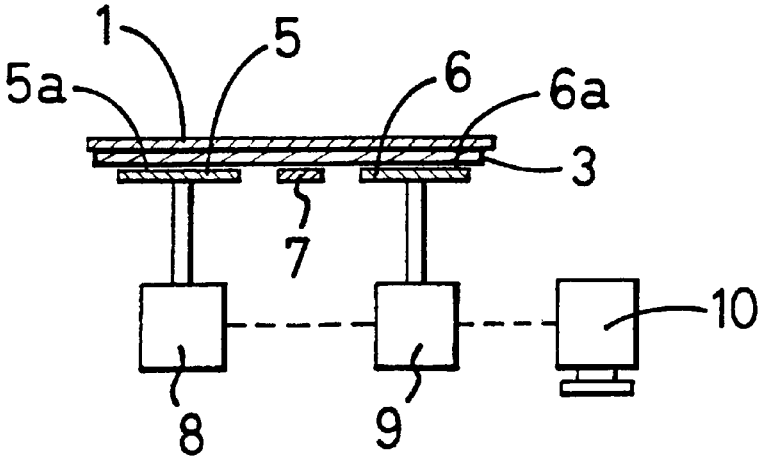
FIG. 4 is a sectional view of the blending device on line iv—iv in FIG. 3.

A blending device generally comprises a door 1 which acts as a carrier support and is pivotable about one end. During use the door 1 acts as a backing support for a bag 3 containing a sample to be blended. Clamping sealing means 4 is provided to hold the bag 3 and provide a seal prior to and during operation of the device.

A kneading means which comprises a first paddle 5 and a second paddle 6 is provided, so that the bag contents can be kneaded by pressure against the backing support of the door. An island baffle 7 is provided between the paddles 5,6. The first paddle 5 has an associated driving means 8 for reciprocatingly driving the first paddle 5 in a direction which is substantially perpendicular to a kneading surface 5*a* of the first paddle 5. Similarly a second driving means 9 is provided for reciprocatingly driving the second paddle 6 in a direction which is substantially perpendicular to a kneading surface 6*a* of the second paddle 6. A common motor 10 provides the power for both of the driving means 8,9 which are each in the form of transmission gearing arrangements. The island baffle 7 is mounted on the structure of the machine so as to remain essentially stationary in use.

The door is pivotable about the hinge between an open position in which the sample bag 3 can be loaded and a closed position in which the sample bag is brought into contact with the clamp 4, so sealing the bag and containing the contents therein. In the closed position the bag 3 and the sample contained therein are brought into contact with the kneading surfaces of the first and second paddles 5, 6 and the island baffle 7.

Figure 3:
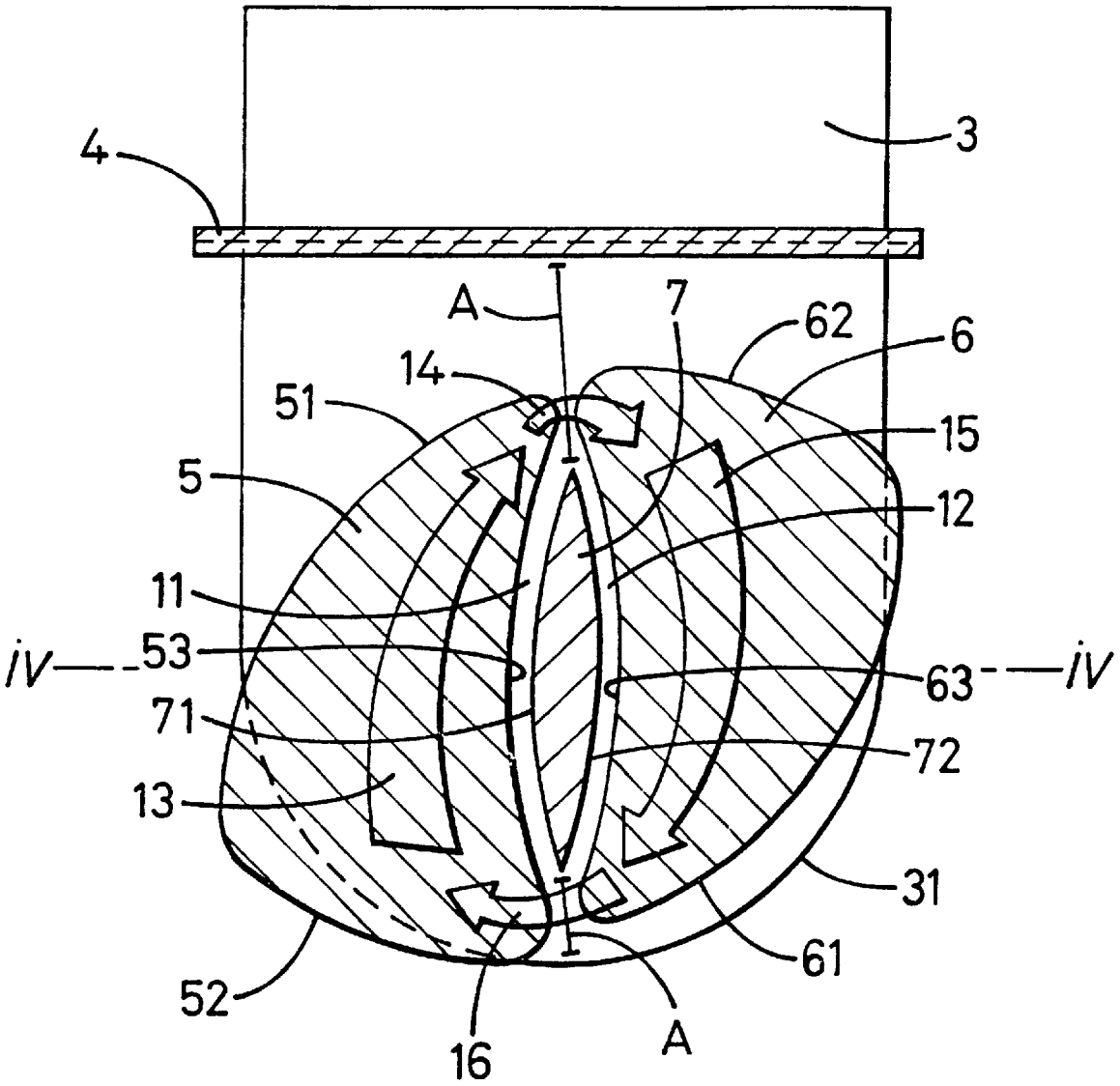
FIG. 3 is a partial front view of the blending device when loaded.

Referring particularly to FIG. 3, the first paddle 5 is formed as a generally triangular plate which is of substantially uniform thickness in the direction perpendicular to the kneading surface and in a plane parallel to the kneading surface is broader at one end than the other. In the orientation shown in FIG. 3, which is the typical orientation in which the device is used, the broad end of the first paddle 5 is disposed below the narrow end of the first paddle 5. Although the first paddle 5 is generally triangular, it has curved rather than straight sides and rounded ends rather than angular vertices. The second paddle 6 has a substantially identical shape to the first paddle 5 but is disposed in an opposed relation to the first paddle 5. That is to say the narrow end of the second paddle 6 is disposed below the broader end in the orientation shown in FIG. 3.

The island baffle 7 is disposed between the first and second paddles 5, 6. Again, referring particularly to FIG. 3, the island baffle 7 is disposed so that a first end of the island baffle 7 is spaced from the clamp 4 and a second end of the island baffle 7 is spaced from an end seal 31 of a loaded sample bag 3. Thus, when a sample bag is loaded into the device gaps A are formed between the ends of the island baffle 7 and the interior boundaries of the bag formed by the upper and lower seals of the bag, the lower of which is semi-circular.

Each of the paddles 5, 6 has two convex sides 51, 61, 52, 62, which face away from the island baffle 7 and a concave side 53, 63 which faces towards the island baffle 7. The island baffle has two convex faces 71 and 72 each of which faces a respective one of the concave faces 53, 63 of the two paddles 5, 6. The facing surfaces 53, 63, 71, 72 of the two paddles 5, 6 and the island baffle 7 define two channels 11 and 12. Assuming that a bag 3 containing a sample has already been loaded into the device so that the door is in the closed position and the bag is sealed by the clamp sealing means 4, the device can be used to homogenize the sample and diluent by using the motors 8 and 9 to reciprocatingly drive the first and second paddles 5, 6 substantially in anti-phase. That is to say, as the first paddle 5 is driven in a forward direction against the bag 3, the second paddle 6 is withdrawn from the bag 3 and vice-versa.

As the first paddle 5 is pushed against the sample containing bag 3 the solid material in the sample will tend to be crushed by the forward motion and these solid elements in addition to liquid and gaseous elements in the material will tend to be driven in an upward direction shown by the arrow 13. This is a direction from the broad end of the first paddle 5 towards the narrow end of the first paddle 5. This tendency for the material to move in the upward direction can be explained by the larger displacement caused by the broader end of the first paddle 5.

The island baffle 7 substantially prevents any transverse movement of the material in the central region of the bag. Instead, this material is forced through the upper aperture A as shown by the arrow 14.

As the first paddle 5 is withdrawn from the bag 3 the second paddle 6 is pushed against the bag 3. Now the same effects occur but in the opposite direction so that the material is both crushed and driven downwards (in the orientation shown in FIG. 3) towards the narrower end of the second paddle 6, as shown by the arrow 15. The material is then driven through the lower aperture A as shown by the arrow 16.

This circulating action continues as the paddles 5, 6 are driven in anti-phase.

The circulating action which occurs is beneficial. This is because when homogenizing specimens with an appropriate diluent to extract into suspension micro-organisms for subsequent analysis, it is important that the resulting suspension is as homogeneous as possible and is as representative as possible of the whole of the material under test. The circulation provided by the present device prevents some portions of the sample being less homogenized than others and helps to mix the sample as a whole. The movement of the diluent created is also of importance because it is not only the crushing of solid elements in the sample which is important, but a washing action which helps to release the organisms from the sample and drive them into suspension.

A further advantage of the present device is that as the material is driven through the apertures A it is extruded and the combination of circulation, extrusion and crushing action improves the microbiological performance of the blender.

The end seal 31 of the bag 3 is semi-circular and is chosen to be of a curvature which closely matches that of the lower curved edges 52, 61 of the paddles. The curvature of the end seal 31 helps to encourage circulation to take place.

The functioning of the device is particularly effective when a gap of around 2 mm is formed between the kneading surfaces and the surface supporting the bag.

It will be appreciated that other means can be used to cause, allow or encourage circulation. For example, the kneading surfaces 5*a*, 6*a* of the two paddles 5, 6 can be further adapted to encourage circulation. In particular the paddles can be arranged so that the broad end of each paddle 5, 6 comes into contact with the bag and the material before the narrow end of the paddle. In the present embodiment that could be achieved by making the paddles 5, 6 with a wedged shaped cross section. Another possibility is to introduce other curved internal boundaries to the bag, for example, by providing a curved door clamp.

In an alternative an island baffle can be provided directly on the door/carrier support.

What is claimed is:

1. A device for blending materials comprising a carrier support arranged to support a closed bag containing a material to be blended, a pair of kneading paddles arranged to apply a kneading action to the bag walls for homogenizing its contents, and a bag holder for holding the closed bag against the carrier support during kneading, the pair of kneading paddles being arranged to act in conjunction with the carrier support to cause the contents of the bag to circulate during kneading, wherein each kneading paddle in the pair of kneading paddles is arranged to act on a different area of the bag and there is an island baffle provided between the kneading paddles in said pair of kneading paddles to substantially prevent movement of material transversely through a central region of the bag.

2. A device according to claim 1 in which the bag holder comprises a clamp.

3. A device according to claim 2 in which the clamp is arranged to provide a temporary seal at an open end of the bag when disposed in the device.

4. A device according to claim 1 in which the pair of kneading paddles are arranged to operate mutually out of phase.

5. A device according to claim 1 in which at least one kneading paddle in the pair of kneading paddles is shaped and dimensioned to encourage circulation.

6. A device according to claim 1 in which the pair of kneading paddles are asymmetrically arranged with respect to each other in a manner which promotes circulation.

7. A device according to claim 1 in which the pair of kneading paddles are provided in an opposed relation such that a broad end of each kneading paddle in the pair is arranged to act on the bag at a region adjacent to a region at which a narrow end of a respective other kneading paddle in the pair is arranged to act.

8. A device according to claim 1 in which the island baffle is disposed such that when the bag is in place in the device, one end of the island baffle is spaced from one internal boundary of the bag so that a first gap is defined between said one end of the island baffle and said one internal boundary of the bag, while another end of the island baffle is spaced from an opposing internal boundary of the bag so that a second gap is defined between said other end of the island baffle and said opposing internal boundary of the bag.

9. A device according to claim 8 which is arranged so that material is extruded on passing through each of said first and second gaps.

10. A device according to claim 1 arranged so that extruding of the material occurs as the material circulates.

11. An assembly for blending materials comprising a sample bag having an arcuate internal boundary in a plane of intended circulation and a device for blending materials comprising a carrier support arranged to support the sample bag containing a material to be blended, a pair of kneading paddles arranged to apply a kneading action to the bag walls for homogenizing its contents, and a bag holder for holding the sample bag against the carrier support during kneading, the pair of kneading paddles being arranged to act in conjunction with the carrier support to cause the contents of the sample bag to circulate during kneading, wherein each paddle in the pair of kneading paddles is arranged to act on a different area of the sample bag and there is an island baffle provided between the kneading paddles in said pair of kneading paddles to substantially prevent movement of material transversely through a central region of the sample bag.

12. An assembly according to claim 11 in which said arcuate internal boundary is substantially semi-circular.

13. An assembly according to claim 11 in which a curvature of said arcuate internal boundary closely matches a curvature of a portion of at least one of the kneading paddles in the pair of kneading paddles.

14. A device for blending materials comprising a carrier support arranged to support a closed bag containing a material to be blended, a kneading means which is arranged to apply a kneading action to the bag walls for homogenizing its contents, and holding means for holding the closed bag against the carrier support during kneading, the kneading means being arranged to act in conjunction with the carrier support to cause the contents of the bag to circulate during kneading, wherein the kneading means comprises a pair of paddles, each paddle in said pair being arranged to act on a different area of the bag and there being an island baffle provided between the paddles to substantially prevent movement of material transversely through a central region of the bag.

* * * * *